United States Patent [19]

Yamada

[11] 4,092,961

[45] June 6, 1978

[54] CARBURETION SYSTEM FOR PREVENTING ENGINE MISFIRES DURING GEAR CHANGES

[75] Inventor: Minoru Yamada, Toyota, Japan

[73] Assignee: Toyota Jidosha Kogyo Kabushiki Kaisha, Toyota, Japan

[21] Appl. No.: 801,798

[22] Filed: May 31, 1977

[30] Foreign Application Priority Data

Mar. 10, 1977 Japan ..... 52-25450

[51] Int. Cl.[2] ..... F02B 33/00

[52] U.S. Cl. ..... 123/119 EC

[58] Field of Search ..... 261/121 B, DIG. 4, DIG. 19; 123/119 EC, 124 R, 124 B, 119 D, 119 DB

[56] References Cited

U.S. PATENT DOCUMENTS

| | | | |
|---|---|---|---|
| 1,463,909 | 8/1923 | Rivers | 123/124 |
| 2,035,237 | 3/1936 | Kushinsky | 123/124 B |
| 2,046,389 | 7/1936 | Kushinsky | 123/124 B |
| 2,085,818 | 7/1937 | Messinger, Jr. | 123/124 B |
| 2,933,168 | 4/1960 | Leibing et al. | 261/DIG. 19 |
| 3,548,792 | 12/1970 | Palmer | 261/121 B |
| 3,590,793 | 7/1971 | Masaki | 123/119 D |
| 3,690,305 | 9/1972 | Shimada et al. | 123/119 EC |
| 3,861,366 | 1/1975 | Masaki et al. | 261/121 B |

*Primary Examiner*—Charles J. Myhre
*Assistant Examiner*—R. A. Nelli
*Attorney, Agent, or Firm*—Stevens, Davis, Miller & Mosher

[57] ABSTRACT

A carburetion system is disclosed for preventing misfires of an engine during gear changes. The system includes a carburetor idle port and, additionally, an idle and slow port positioned near the throttle valve. Both ports are in communication with a idle and slow fuel passage. A valve controls the entry of air into the slow fuel passage during gear changes. The valve is opened by a circuit which functions to detect the concurrence of (1) the pushed-down position of the clutch pedal, and (2) the idle opening position of the throttle valve. A timing device is included for closing the valve a predetermined period of time after the clutch has been pushed down and the throttle valve has assumed its idle opening position.

7 Claims, 1 Drawing Figure

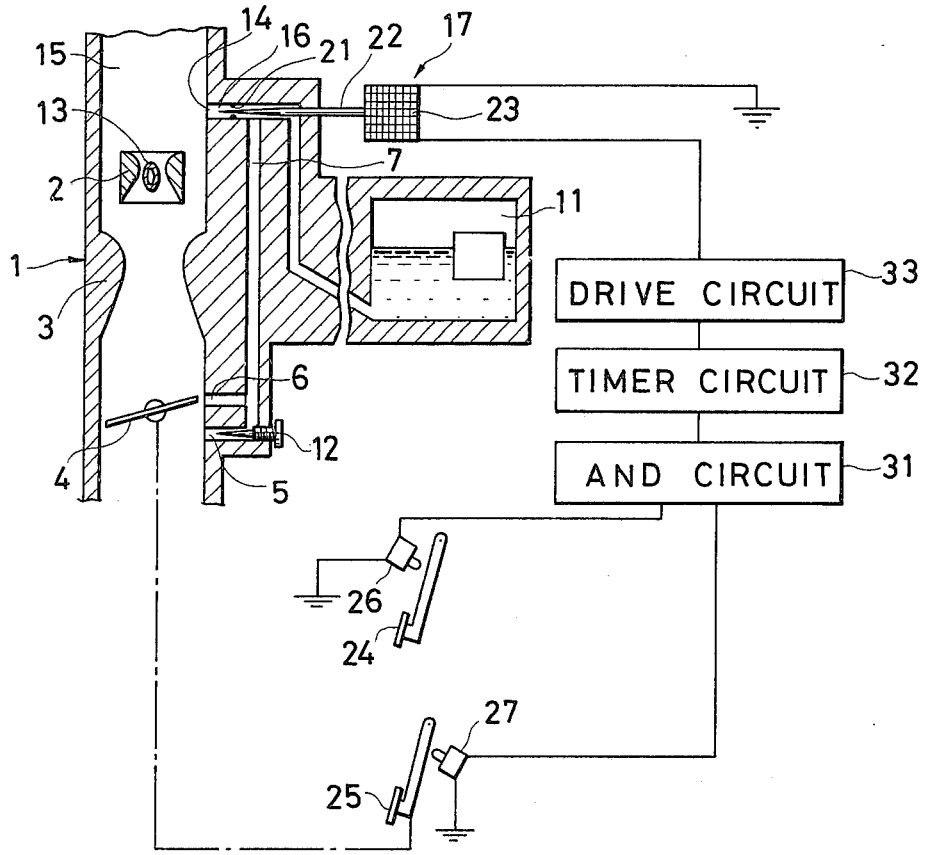
14
16
21
22
17
15
13
23
7
2
11
1
3
DRIVE CIRCUIT
33
TIMER CIRCUIT
32
6
12
AND CIRCUIT
31
4
5
26
24
27
25

CARBURETION SYSTEM FOR PREVENTING ENGINE MISFIRES DURING GEAR CHANGES

BACKGROUND OF THE INVENTION

1. Field of the Invention

This invention relates to a carburetor for use in an internal combustion engine of an automobile, and, more particularly, to a carburetor in which the supply of a super-rich mixture charge to an engine is prevented at the time of changing gears. This results in the prevention of a misfire and, correspondingly, in the prevention of any increase in the amount of unburnt, harmful constituents present in the exhaust gases.

2. Description of the Prior Art

An idle port is provided for insuring that a preselected amount of fuel is supplied to the engine at the time of idling; a fuel passage connects the idle port with a float bowl containing fuel. Upon changing gears, the accelerator pedal is released, bringing the throttle valve to its idle opening position, so that the amount of air being supplied to the engine is reduced. This causes an increase in the flow rate of fuel being supplied through the idle port to the engine because of an increased vacuum in the intake passage. As a result, a super-rich mixture charge is introduced which tends to cause a misfire as well as a corresponding increase in the amount of unburnt, harmful constituents present in the exhaust gases.

SUMMARY OF THE INVENTION

It is a principal object of the present invention to provide a carburetor which, at the time of changing gears, avoids the aforesaid shortcomings experienced with prior art carburetors by preventing the noted increase in the flow rate of fuel supplied to the engine, thereby preventing misfires and accompanying increase in the amount of unburnt, harmful constituents present in the exhaust gases.

It is another object of the present invention to provide a carburetor which may supply air downstream of the throttle valve at the time of changing gears.

It is a further object of the present invention to provide a carburetor to prevent the supply of a super-lean mixture charge to the engine a given time after changing gears.

One aspect of the present invention concerns a carburetor which comprises: means for generating an output in response to the concurrence of a pushed-down position of the clutch pedal and an idle opening position of the throttle valve; an idle and slow fuel passage for directing fuel to a slow port which is positioned near the throttle valve and an idle port located downstream of the slow port; and, valve means for controlling the communication between the atmosphere and the idle and slow fuel passage in accordance with the aforesaid output, whereby air is introduced into the idle and slow fuel passage at the time of changing gears.

According to another aspect of the present invention, there is provided a carburetor which further comprises another means for closing the valve means a given time after the clutch pedal has been pushed down and the throttle valve has assumed an idle opening position.

BRIEF DESCRIPTION OF THE DRAWING

The drawing is a diagrammatic view of a carburetor and its associated control mechanisms according to the present invention.

DESCRIPTION OF THE PREFERRED EMBODIMENT

The present invention will now be described in more detail in conjunction with the accompanying drawing which indicates one embodiment of the invention. Carburetor 1 includes a small venturi portion 2, a large vanturi portion 3 and a throttle valve 4. The lower end of carburetor 1 is connected in conventional fashion through an intake manifold to an engine, neither being shown in the drawing. An idle port 5 is positioned such that it is downstream from the edge of throttle valve 4 when throttle valve 4 is at an idle opening position. Idle port 5 opens into an intake passage leading to the intake manifold. A slow port 6 is positioned upstream of idle port 5 such that slow port 6 may be located either upstream or downstrem of the edge of throttle valve 4, depending on the operating position of throttle valve 4. An idle and slow fuel passage 7 communicates idle port 5 and slow port 6 with a float bowl 11 having fuel stored therein. A screw 12 adjusts the cross-sectional opening of the passage leading to idle port 5.

Referring now to the carburetor air intake, as is well known, a main nozzle 13 is open in small venturi portion 2 and connected to float bowl 11. A port 14 is provided in air intake 15 upstream of throttle valve 4. Port 14 communicates via a passage 16 with idle and slow fuel passage 7. An eletromagnetic valve 17 opens and closes passage 16. Electromagnetic valve 17 includes a valve seat 21, a stem 22 cooperative therewith within passage 16, and a coil 23 for operating stem 22. Clutch pedal 24 and an accelerator pedal 25 are, of course, in the driver's compartment. Throttle valve 4 is linked to accelerator pedal 25 to vary its opening in response to the position of the pedal. A limit switch 26 is positioned adjacent clutch pedal 24 and will open its contacts when clutch pedal 24 is pushed down, and close its contacts when clutch pedal 24 is released. A limit switch 27 is positioned adjacent accelerator pedal 25 and will close its contacts when accelerator pedal 25 is pushed down, and open its contacts when accelerator pedal 25 is released. The limit switches 26, 27 are connected to input terminals of a known coincidence detecting circuit such as AND circuit 31. The output of AND circuit 31 is fed to a known timer circuit 32. The output of timer circuit 32 is in turn fed to a known drive circuit 33. The output terminal of drive circuit 33 is connected to one terminal of coil 23 of electromagnetic valve 17; the other terminal thereof is grounded.

Except during the time when gears are being changed, either clutch pedal 24 is released (not depressed) or accelerator pedal 25 is pushed down. In other words, at least one of the limit switches 26 and 27 usually has its contacts closed. At this time AND circuit 31, which detects signals from limit switches 26,27, maintains its output signal at a voltage value A. The output A is in turn fed via timer circuit 32 to drive circuit 33, which maintains the coil 23 de-energized. The coil will remain de-energized as long as the output of AND circuit 31 is maintained at a voltage value A. Accordingly, stem 22 in electromagnetic valve 17 closely contacts valve seat 21, thereby blocking the introduction of air through port 14 into idle and slow fuel passage 7. As a result, fuel is supplied through the idle and slow fuel passage, idle port 5 and slow port 6 into the engine in response to an opening of throttle valve 4.

When gears are changed, clutch pedal 24 is pushed down while accelerator pedal 25 is released. When this occurs, both limit switches 26,27 open their contacts at a time $t_1$, causing the output of the AND circuits 31 to change from a voltage value A to a voltage value B. The output B of AND circuit 31 is fed via timer circuit 32 to drive circuit 33, causing energization of coil 23. The stem 22 is pulled back by coil 23 from valve seat 21 so that air is introduced, due to a vacuum in the intake passage, through port 14 into the idle and slow fuel passage 7. In this manner, air is supplied through idle port 5 to the engine, thereby preventing a supply of a super-rich mixture charge thereto. When a predetermined period of time T (for instance one second) has elapsed, after the limit switches 26,27 have opened their contacts, i.e., a given time T after the time $t_1$, (i.e., at the time $t_2$), timer circuit 32 changes output B of AND circuit 31 to output A, which in turn is fed to the drive circuit 33, thereby causing a de-energization of coil 23. Accordingly, stem 22 in electromagnetic valve 17 contacts valve seat 21, thereby closing passage 16. From the time $t_2$ on, air can no longer be introduced through port 14 into the idle and slow fuel passage 7. In this manner, a supply of super-lean mixture charge to the engine is prevented, thereby preventing a misfire which would be caused by the continuing supply of air to idle and slow fuel passage 7.

As is apparent from the foregoing description of the carburetor according to the present invention, the supply of a super-rich mixture charge to the engine through idle port 5 is prevented at the time of changing gears. Accordingly, misfire of the engine due to an excessively rich mixture charge is prevented, with the resulting prevention of an increase in the amount of unburnt, harmful constituents in the exhaust gases.

In addition, timer circuit 32 controls the amount of air to be supplied to the engine at the time of changing gears so that the supply of a super-lean mixture charge to the engine is also prevented, with the resulting prevention of misfire.

While the present invention has been described herein with reference to a certain exemplary embodiment thereof, it should be understood that various changes, modifications and alterations may be effected without departing from the spirit and the scope of the present invention, as defined in the appended claims.

What is claimed is:

1. A carburetion system for use in an internal combustion engine of a vehicle comprising:
   - an intake passage for said engine;
   - a throttle valve located in said intake passage;
   - an idle port open in said intake passage;
   - means for providing a first signal when a clutch pedal of said vehicle is depressed;
   - means for providing a second signal when said throttle valve is at an idle opening position;
   - a coincidence detecting circuit for detecting the simultaneous occurrence of said first and second signals and providing an output signal when coincidence is detected, said output signal representing a gear changing condition;
   - a fuel passage for directing fuel to said idle port;
   - valve means for opening a communication path between the atmosphere and said fuel passage in response to said output signal, whereby air is introduced into said fuel passage at the time of changing gears; and
   - timing means for closing said valve means a predetermined period of time after said coincidence detecting circuit provides said output.

2. The carburetion system of claim 1 wherein one of said signals is generated by a first switch responsive to movement of said clutch pedal, and the other signal is generated by a second switch responsive to movement of an accelerator pedal, said accelerator pedal moving in conjunction with said throttle valve.

3. The carburetion system of claim 2 wherein said first and second switches are limit switches which are responsive to detect the movement of said clutch pedal and said accelerator pedal from respective predetermined rest positions.

4. The carburetion system of claim 1 wherein said coincidence detecting circuit comprises an AND circuit.

5. The carburetion system of claim 1 wherein said timing means comprises a timer circuit connected to a drive circuit.

6. The carburetion system of claim 1 wherein said valve means comprises an electromagnetic valve.

7. The carburetion system of claim 1 further comprising a slow port communicating with said fuel passage and positioned such that it may be downstream or upstream of an edge of said throttle valve depending on the opening of said throttle valve.

* * * * *